US011041686B2

(12) United States Patent
Diaz

(10) Patent No.: US 11,041,686 B2
(45) Date of Patent: Jun. 22, 2021

(54) ELECTRONIC FIRING RIFLE ASSEMBLY

(71) Applicant: Marc H. Diaz, Plantation, FL (US)

(72) Inventor: Marc H. Diaz, Plantation, FL (US)

( * ) Notice: Subject to any disclaimer, the term of this patent is extended or adjusted under 35 U.S.C. 154(b) by 0 days.

(21) Appl. No.: 16/919,052

(22) Filed: Jul. 1, 2020

(65) Prior Publication Data

US 2021/0102773 A1 Apr. 8, 2021

Related U.S. Application Data

(60) Provisional application No. 62/869,462, filed on Jul. 1, 2019.

(51) Int. Cl.

| | |
|---|---|
| ***F41A 19/64*** | (2006.01) |
| ***F41A 19/69*** | (2006.01) |
| ***F41A 3/66*** | (2006.01) |
| ***F41A 21/48*** | (2006.01) |
| ***F41A 15/14*** | (2006.01) |

(52) U.S. Cl.

CPC ..... *F41A 19/64* (2013.01); *F41A 3/66* (2013.01); *F41A 15/14* (2013.01); *F41A 19/69* (2013.01); *F41A 21/484* (2013.01)

(58) Field of Classification Search

CPC .. F41A 19/64; F41A 3/66; F41A 15/14; F41A 19/69; F41A 21/484

See application file for complete search history.

(56) References Cited

U.S. PATENT DOCUMENTS

| | | | | |
|---|---|---|---|---|
| 2,741,162 | A * | 4/1956 | Gnam | F41A 17/16 89/135 |
| 2,868,082 | A * | 1/1959 | Nutting | F41A 3/40 89/190 |
| 3,503,330 | A | 3/1970 | Dardick | |
| 3,580,113 | A | 5/1971 | Ramsay et al. | |
| 3,618,457 | A | 11/1971 | Miller | |
| 4,555,972 | A | 12/1985 | Heyne | |
| 4,604,942 | A | 8/1986 | Benelli | |
| 4,748,892 | A | 6/1988 | Dardick et al. | |
| 5,755,056 | A * | 5/1998 | Danner | F41A 3/22 42/84 |
| 5,806,226 | A | 9/1998 | Norton et al. | |
| 6,951,071 | B1 * | 10/2005 | Acosta | F41A 19/59 42/42.01 |

(Continued)

*Primary Examiner* — Joshua E Freeman
(74) *Attorney, Agent, or Firm* — Mark C. Johnson; Johnson Dalal

(57) ABSTRACT

An electronic firing rifle assembly includes a salvo rifle operable through electrical means to efficiently discharge a salvo of projectiles. The assembly includes a firearm receiver body that provides housing for internal action components. The firearm receiver body has an inner surface defined by cam slots. The assembly also includes a barrel subassembly having a barrel and a plurality of barrel guide cams extending radially within the cam slots formed in the firearm receiver body. The assembly also includes a reciprocating bolt defined by has an ammunition placement zone for retaining ammunition, such as a round. A leaf spring ejects the ammunition after discharge of projectiles. The bolt is defined by a cam track that allows the bolt to rotatably and longitudinally reciprocate along a bolt translation path in a helical path. Data pertaining to the location and direction of projectile discharge is transmitted for identifying discharge locations and tracking.

20 Claims, 15 Drawing Sheets

(56) References Cited

U.S. PATENT DOCUMENTS

| | | | | |
|---|---|---|---|---|
| 7,806,039 | B1 | 10/2010 | Gomez | |
| 7,819,051 | B1 | 10/2010 | Beckmann et al. | |
| 7,886,470 | B1 | 2/2011 | Doiron | |
| 8,713,833 | B2 | 5/2014 | Lewis et al. | |
| 9,163,900 | B2 | 10/2015 | Dardick et al. | |
| 9,200,856 | B2 | 12/2015 | Moretti | |
| 10,309,743 | B2 * | 6/2019 | Rami | F42C 19/0834 |
| 2002/0078615 | A1 * | 6/2002 | Danner | F41A 19/58<br>42/69.01 |
| 2006/0162217 | A1 | 7/2006 | Longueira | |
| 2015/0115880 | A1 * | 4/2015 | Soar | H02J 50/12<br>320/108 |
| 2016/0084601 | A1 * | 3/2016 | Alicea, Jr. | F41A 17/20<br>42/6 |
| 2017/0067715 | A1 * | 3/2017 | Conant | F41A 21/48 |
| 2017/0198994 | A1 * | 7/2017 | Grier | F41A 9/25 |
| 2019/0003803 | A1 * | 1/2019 | Kapogianis | G09B 9/003 |

* cited by examiner

ELECTRONIC FIRING RIFLE ASSEMBLY

CROSS-REFERENCE TO RELATED APPLICATION

This application claims priority to U.S. Provisional Patent Application No. 62/869,462, filed Jul. 1, 2019, the entirety of the same is incorporated by reference.

FIELD OF THE INVENTION

The present invention relates generally to electronic firearms, and, more particularly, relates to electronic firing rifle assemblies.

BACKGROUND OF THE INVENTION

Generally, a Salvo rifle is a revolutionary departure from the known prior art. It combines well-proven technologies with a unique bolt and method of operation. Together the proven and new technologies result in a rifle with disruptive advantages in lethality and reliability. An important advantage is the ability to send multiple projectiles down range for a single perceived recoil of the firearm. In other words, "salvo firing." It well known that using stacked projectiles inside the ammunition allows two or more projectiles to be fired for each perceived recoil of the firearm, i.e., salvo firings. This is well known to increase hit probability because projectile drop and gyroscopic drift will increase the impact area. This is especially true when firing upon fleeting targets.

The state of the art for current rifles is in a technological cul-de-sac. Conventional metallic cartridges and operating systems are approaching the outer limits of their capabilities and for many years, performance improvements have been incremental and have achieved diminishing returns. The Salvo rifle uses fewer and more robust parts than known prior art. There is no gas diversion, gas tube, piston or impingement of any kind. The result is that maintenance requirements will be less than known prior art.

Efforts to improve reliability, hit probability and functionality have all foundered. There is a demonstrated urgent requirement for improvements over current art. Prior attempts at producing a salvo capable weapon have failed for a variety of reasons. The Salvo rifle is the way out of this cul-de-sac.

Therefore, a need exists to overcome the problems with the prior art as discussed above.

SUMMARY OF THE INVENTION

The invention provides an electronic firing rifle assembly that overcomes the hereinafore-mentioned disadvantages of the heretofore-known devices and methods of this general type and that provides a salvo rifle operable through electrical means to efficiently discharge a salvo of projectiles. The electronic firing rifle assembly includes a firearm receiver body that provides housing for internal action components, and is defined by an inner surface having cam slots. The assembly also includes a barrel subassembly having a barrel and a plurality of barrel guide cams extending radially within the cam slots formed in the firearm receiver body. The electronic firing rifle assembly also includes a reciprocating bolt defined by has an ammunition placement zone for retaining ammunition, such as a tround. The bolt houses a leaf spring that ejects the ammunition after discharge of projectiles. The bolt is defined by a cam track that allows the bolt to rotatably and longitudinally reciprocate along a bolt translation path in a helical path.

With the foregoing and other objects in view, there is provided, in accordance with the invention, an electronic firing rifle assembly, such as a rifle salvo, which is operable to discharge multiple projectiles through electrical means. In some embodiments, the electronic firing rifle assembly comprises a firearm receiver body that is defined by an ejection port and with a sidewall defining an internal enclosed channel and a plurality of cam slots. The cam slots are independently defined and disposed on an inner surface of the sidewall of the firearm receiver body. At least one bolt cam follower protrudes from the inner surface of the sidewall for the firearm receiver body.

The firearm receiver body is also defined by a buttstock that houses electrical components for powering the discharge of the ammunition. For example, an electric current is used to ignite an ammunition ignitor, or propellant, which fires the ammunition. In one possible embodiment, the electrical components include a power source electrically coupled to an electronic controller and including an electronic trigger switch coupled thereto.

The assembly may also include a barrel subassembly coupled to the firearm receiver body, and having a barrel defining a barrel chamber and a plurality of barrel guide cams. The barrel guide cams are disposed on, and extend radially from an exterior surface thereof and at least partially within, respectively, the plurality of cam slots. In one embodiment, a bolt shield couples to the barrel and with a barrel face interposed between the bolt shield and the barrel.

In some embodiments, the assembly also comprises a bolt that works in conjunction with the firearm receiver body and the barrel subassembly. The bolt has an external surface that defines an ammunition placement zone for placing ammunition, such as a tround containing projectiles. The bolt is also defined by a cam track disposed and defined thereon. The at least one bolt cam follower that projects from the inner surface of the sidewall for the firearm receiver body is disposed within the cam track of the bolt. As the bolt is axially displaced during discharge and recoil, the bolt follows a recoil cam track path and a return cam track path. Each path follows a curvilinear shape different than one another.

As discussed above, the assembly is an electrical firearm. Thus, one or more electrical firing contacts are disposed proximal to the ammunition placement zone of the bolt, so as to be disposed on the external surface of the bolt. The electrical firing contacts actuate discharge of the assembly. And when discharged, the bolt is forcibly urged to rotatably and longitudinally translate along a bolt translation path defined by the at least one bolt cam follower disposed within the cam track of the bolt.

The bolt is thus, transposed between a firing position and a reloading position while following the bolt translation path. The firing position is configured, such that at least one of the electrical firing contacts is disposed on the external surface of the bolt, and the electrical firing contacts electrically coupled to the electronic controller and with the ammunition placement zone axially aligned with the barrel chamber. The reloading position is configured, such that at least one of the electrical firing contacts is disposed on the external surface of the bolt and the electrical firing contacts electrically uncoupled from the electronic controller.

In accordance with another feature of the electronic firing rifle assembly, the bolt further comprises an ejector spring coupled thereto; and at least one ejector prong at least partially disposed within at least one prong hole defined by the bolt and having one end directly coupled to the ejector spring and another end operably configured to protrude into the ammunition placement zone with biasing force provided by the ejector spring.

In accordance with another feature of the electronic firing rifle assembly, the ejector spring comprises a leaf spring.

In accordance with another feature of the electronic firing rifle assembly, the ammunition placement zone is of a shape and size configured to contour and at least partially directly coupled to a piece of ammunition on at least two sides and at least one end of the piece of ammunition.

In accordance with another feature of the electronic firing rifle assembly, the ammunition comprises an ammunition ignitor.

In accordance with another feature of the electronic firing rifle assembly, the ammunition comprises a tround.

In accordance with another feature of the electronic firing rifle assembly, the tround contains multiple projectiles.

In accordance with another feature of the electronic firing rifle assembly, the cam slots are defined by the firearm receiver body are of a linear orientation; and the barrel guide cams are of a plate-like structure.

In accordance with another feature of the electronic firing rifle assembly, the firing position of the bolt translation path includes the bolt shield superimposing the ammunition placement zone.

In accordance with another feature of the electronic firing rifle assembly, the reloading position is oriented approximately 90° to 180° with respect to the firing position.

In accordance with another feature of the electronic firing rifle assembly, the recoil cam track path orients the ammunition placement zone of the bolt to align with the ejection port of the firearm receiver body when in recoil. The track does not carry the chamber of the ejection port when it is returning to battery.

In accordance with another feature of the electronic firing rifle assembly, the configuration of the bolt shield is C-shaped.

In accordance with another feature of the electronic firing rifle assembly, the configuration of the barrel face is disc-shaped.

In accordance with another feature of the electronic firing rifle assembly, further comprising a firing ignitor disposed at one end of the ammunition placement zone, the firing ignitor being in electrical communication with the electrical firing contacts, the firing ignitor further being selectively engaged with the ammunition when disposed in the ammunition placement zone. The firing ignitor is part of the ammunition, or tround.

In accordance with another feature of the electronic firing rifle assembly, further comprising an electrical inlet and an electrical outlet formed at one end of the bolt, the electrical inlet and outlet being in communication with the electrical firing contacts.

In accordance with another feature of the electronic firing rifle assembly, further comprising an electrical inlet and an electrical outlet formed in the bolt shield, the inlet and outlet being in communication with the electrical inlet and the electrical outlet formed at one end of the bolt.

In accordance with another feature of the electronic firing rifle assembly, further comprising a trigger subassembly coupled to the firearm receiver body, and operatively connected to the electrical firing contacts.

The preferred embodiment is to use electrical firing. However, a mechanical means of firing such as using a traditional hammer is an alternative. A preferred embodiment is to use multiple projectiles. However, single projectiles are also possible. A preferred embodiment is to use stacked or "telescoping" projectiles. However, multiple bores can be used as well to achieve the same result. The term "round" is defined as a triangular cartridge. See Dardick U.S. Pat. No. 3,434,380. This is the preferred embodiment.

Although the invention is illustrated and described herein as embodied in a Electronic Firing Rifle Assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the barrel subassembly.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION OF INVENTION

Figure 1:
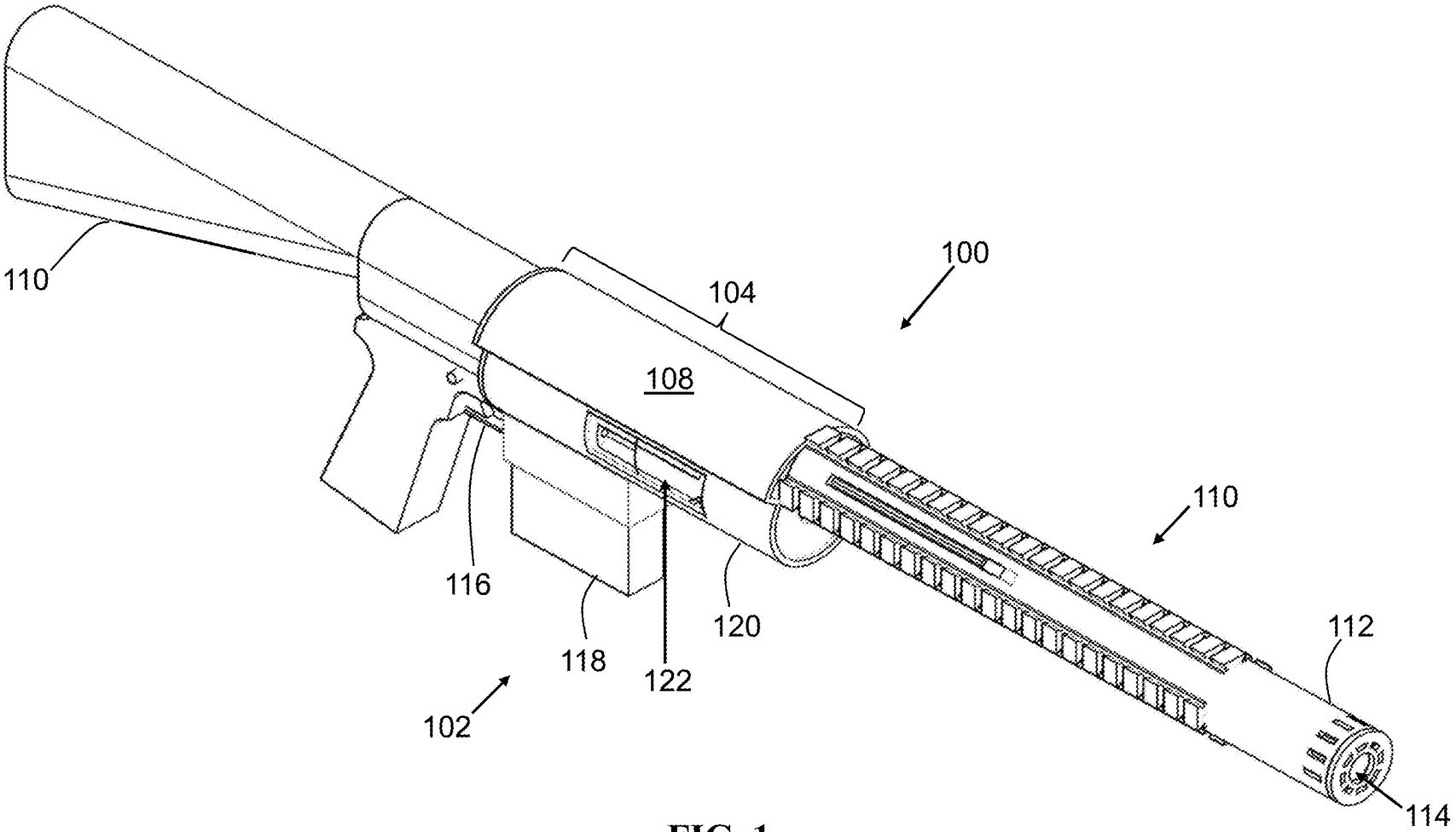
FIG. 1 is a perspective view of an exemplary electronic firing rifle assembly, showing a salvo rifle, in accordance with the present invention.

The invention described herein provides an electronic firing rifle assembly that overcomes known disadvantages of those known devices and methods of this general type and that effectuates efficient and effective firing of an electronic firearm employing open chamber and/or triangular (or "tround") technology. Although the invention is illustrated and described herein as embodied in an electronic firing rifle assembly, it is, nevertheless, not intended to be limited to the details shown because various modifications and structural changes may be made therein without departing from the spirit of the invention. Additionally, well-known elements of exemplary embodiments of the invention will not be described in detail or will be omitted so as not to obscure the relevant details of the invention.

It is to be understood that the disclosed embodiments herein are merely exemplary of the invention, which can be embodied in various forms. Therefore, specific structural and functional details disclosed herein are not to be interpreted as limiting, but merely as a basis for future claims and as a representative basis for teaching one of ordinary skill in the art to variously employ the present invention in virtually any appropriately detailed structure. Further, the terms and phrases used herein are not intended to be limiting; but rather, to provide an understandable description of the invention. It is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the barrel of the firearm, wherein "transverse" should be understood to mean a direction corresponding to a direction opposite of the longitudinal direction. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

The attached figures are incorporated in and form part of the specification, and serve to further illustrate various embodiments and explain various principles and advantages all in accordance with the present invention. Moreover, it is believed that the invention will be better understood from a consideration of the following description in conjunction with the drawing figures, in which like reference numerals are carried forward.

Figure 2:
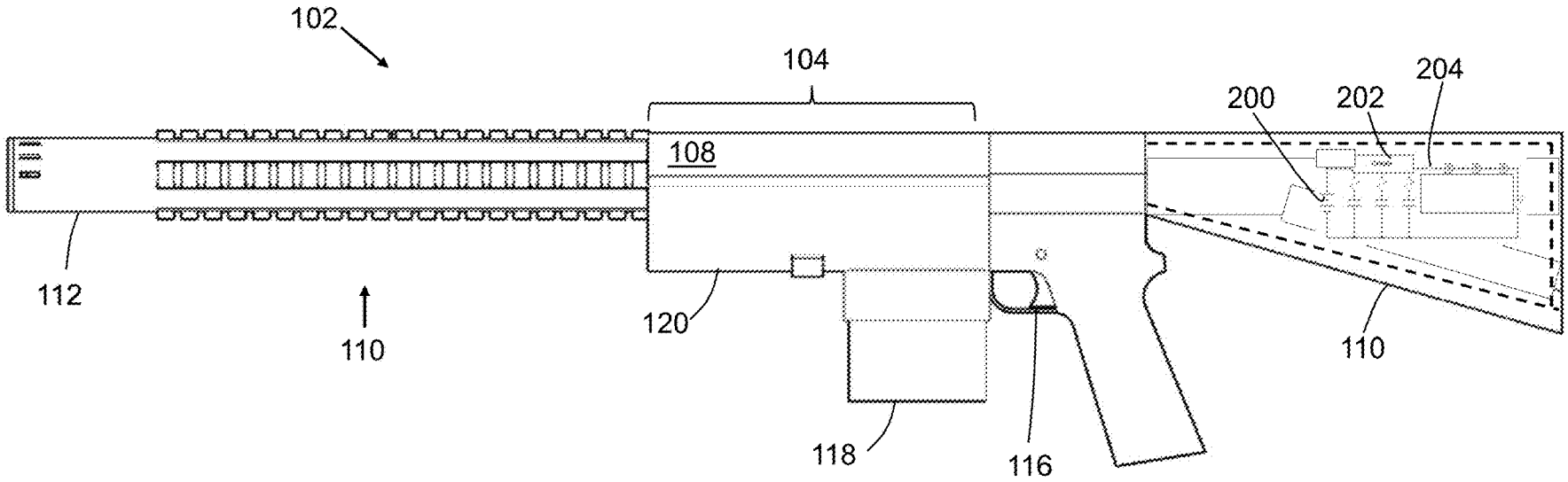
FIG. 2 is an elevated side view of the electronic firing rifle assembly, showing a section buttstock with electrical components houses therein, in accordance with the present invention.

Referring now to FIGS. 1-17, one embodiment depicting various components of the present invention is shown. A perspective view of an electronic firing rifle assembly 100 is shown in FIG. 1. The electronic firing rifle assembly 100, hereafter "assembly 100" may be configured as an electrical salvo rifle 102. An exemplary salvo rifle 102, e.g., automatic rifle, seen in FIG. 2, along with other figures depicted herein, show several advantageous features of the present invention. But as will be described below, the salvo rifle 102 can be provided in several shapes, sizes, combinations of features and components. For this description, a rifle version of the assembly 100 is illustrated. However, in alternative embodiments, different variations of rifles and firearms may be used.

The electrical salvo rifle 102 is operable to simultaneously discharge one or more projectiles 800*a-n* from a piece of ammunition 310 through electrical actuation means. The use of a salvo firing mechanism improves reliability, hit probability, and functionality. Also, being electrical, an electrical current, rather than powder or primer, is used to ignite an ammunition ignitor 802, so as to propel the ammunition 310. The electrical means provides the advantage of reducing moving parts, since there is no gas diversion, gas tube, piston, or impingement of any kind. The result is that maintenance requirements will be less than known prior art.

Figure 3:
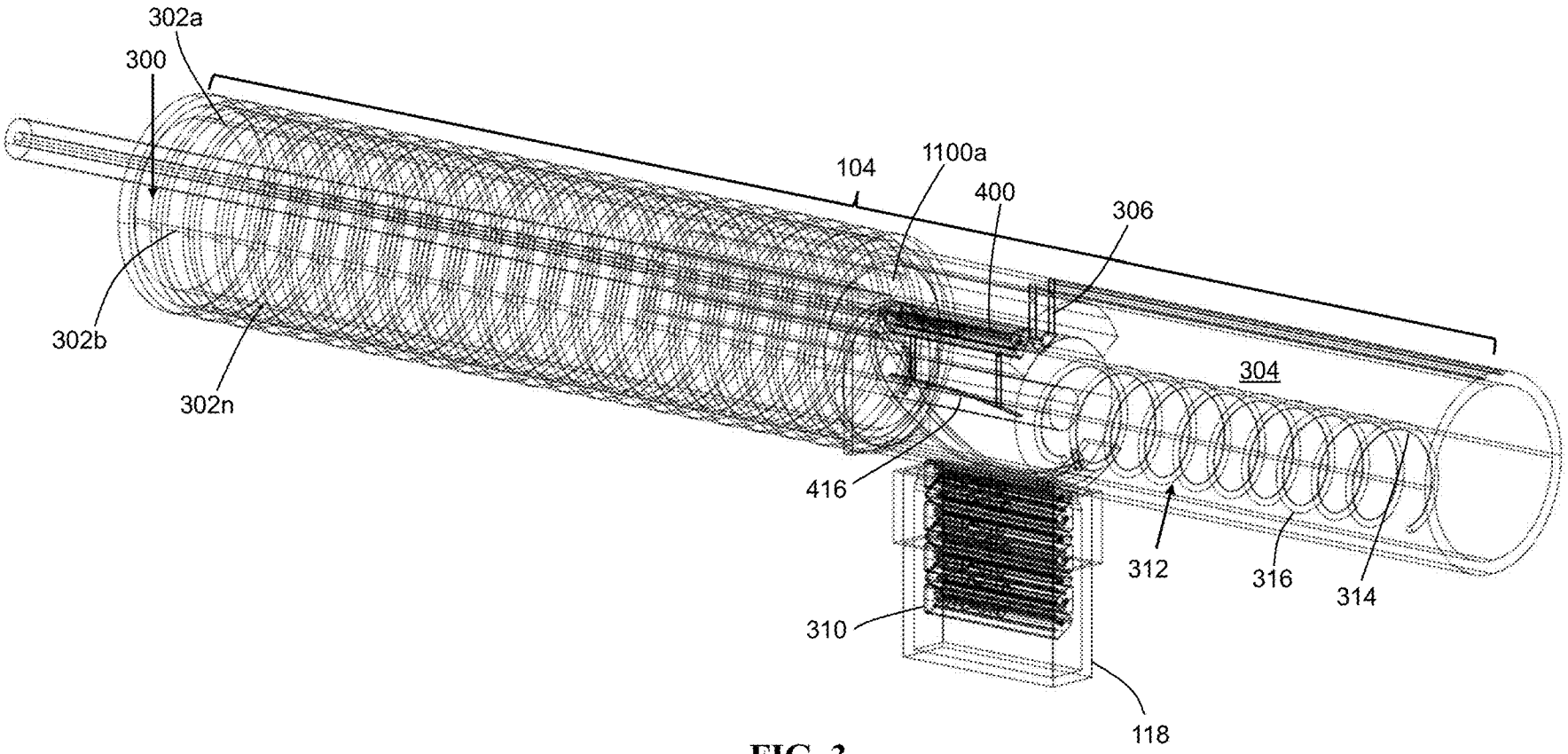
FIG. 3 is a sectioned side view of an exemplary firearm receiver body, in accordance with the present invention.

Looking now at FIG. 3, the assembly 100 includes a firearm receiver body 104 that houses the internal action components of the salvo rifle 102. The firearm receiver body 104 may be defined by a sidewall 108 having an inner surface 304. The sidewall 108 may be rectangular or curved in shape. In some embodiments, the sidewall 108 of the firearm receiver body 104 defines an internal enclosed channel 300 and an ejection port 122 oriented towards the top end of the firearm receiver body 104. The ejection port 122 provides an outlet for spent ammunition shells after discharge.

Figures 9, 10, 11:
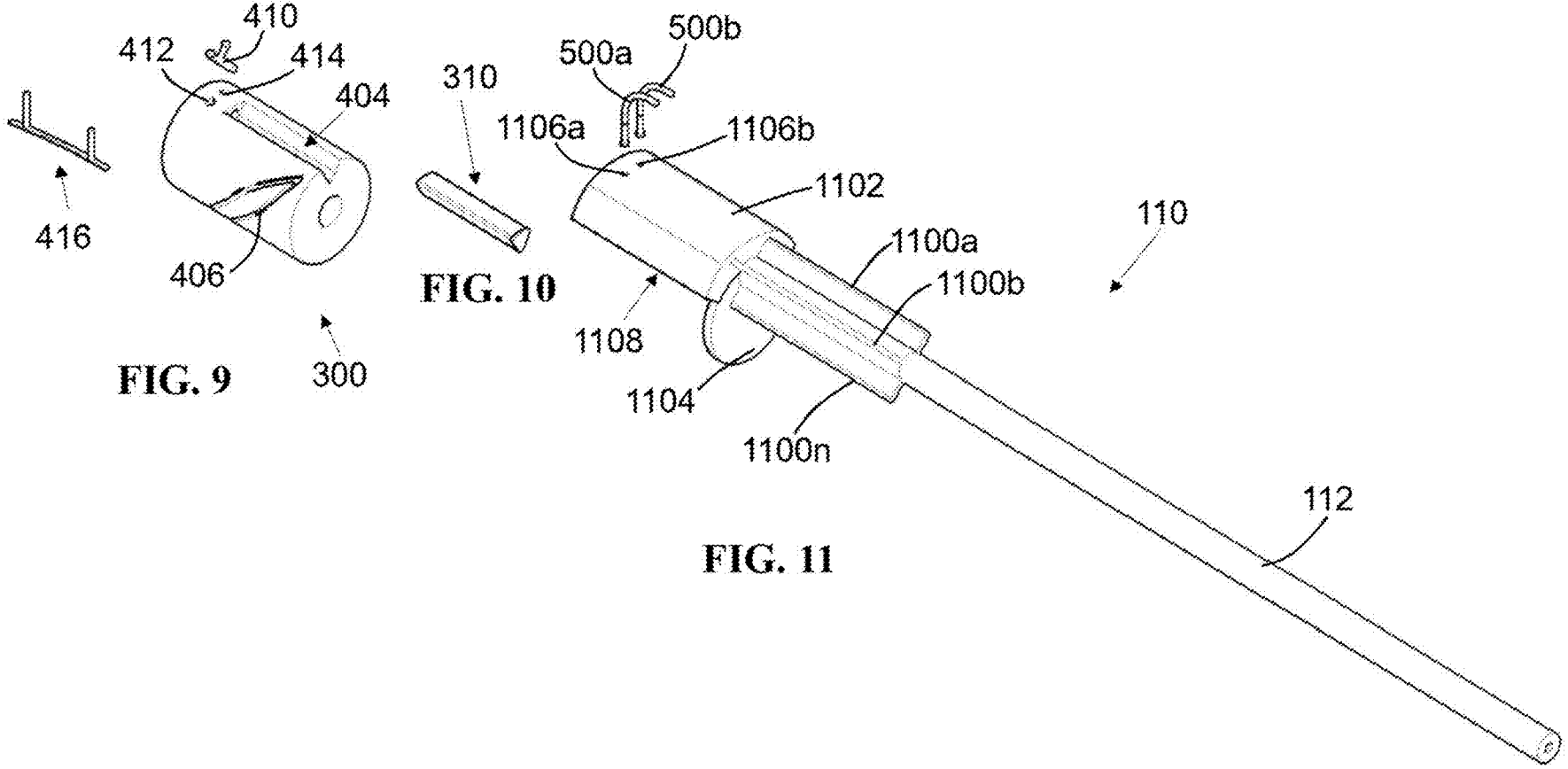
FIG. 9 is a perspective view of an exemplary bolt, in accordance with the present invention.
FIG. 10 is a perspective view of an exemplary ammunition, in accordance with the present invention.
FIG. 11 is a perspective view of an exemplary barrel subassembly aligned with an exemplary bolt and ammunition, in accordance with the present invention.

The inner surface of sidewall 108 also defines a plurality of cam slots 302*a*, 302*b*, 302*n* in the forestock of the firearm that are configured to receive a portion of the bolt shield 1102 (as best depicted in FIG. 11) that is in front of the bolt 400. In one possible embodiment, the cam slots 302*a-n* are of a linear orientation, extending along the longitudinal of the firearm receiver body 104 to the front of the firearm. The cam slots 302*a-n* may be independently defined and disposed on an inner surface 304 of the sidewall 108 of the firearm receiver body 104.

As discussed below, the cam slots 302*a*, 302*b*, 302*n* help retain a barrel subassembly 110 in the firearm receiver body 104 during discharge and recoil of the rifle salvo 102. Furthermore, at least one bolt cam follower 306 may protrude from the inner surface 304 of the sidewall 108. In preferred embodiments, for stability, two bolt followers are utilized on opposing sides of the firearm receiver body 104. As discussed below, the bolt cam follower 306 may of a pin-like structure that is inserted within and engages a cam track 406 in a bolt 400 to guide the bolt 400 along a bolt translation path during discharge and recoil of the rifle salvo 102.

In some embodiments, the firearm receiver body 104 may include one or more components, including, but not limited to, the buttstock 110, which may be disposed at the rear end of the salvo firearm 102. The buttstock 110 may be sized and dimensioned to house various electrical components for igniting discharge of the ammunition 310. In one possible embodiment, the electrical components include a power source 200 electrically coupled to an electronic controller 202 and including an electronic trigger switch 204 coupled thereto and housed within the firearm receiver body 104.

Figure 14:
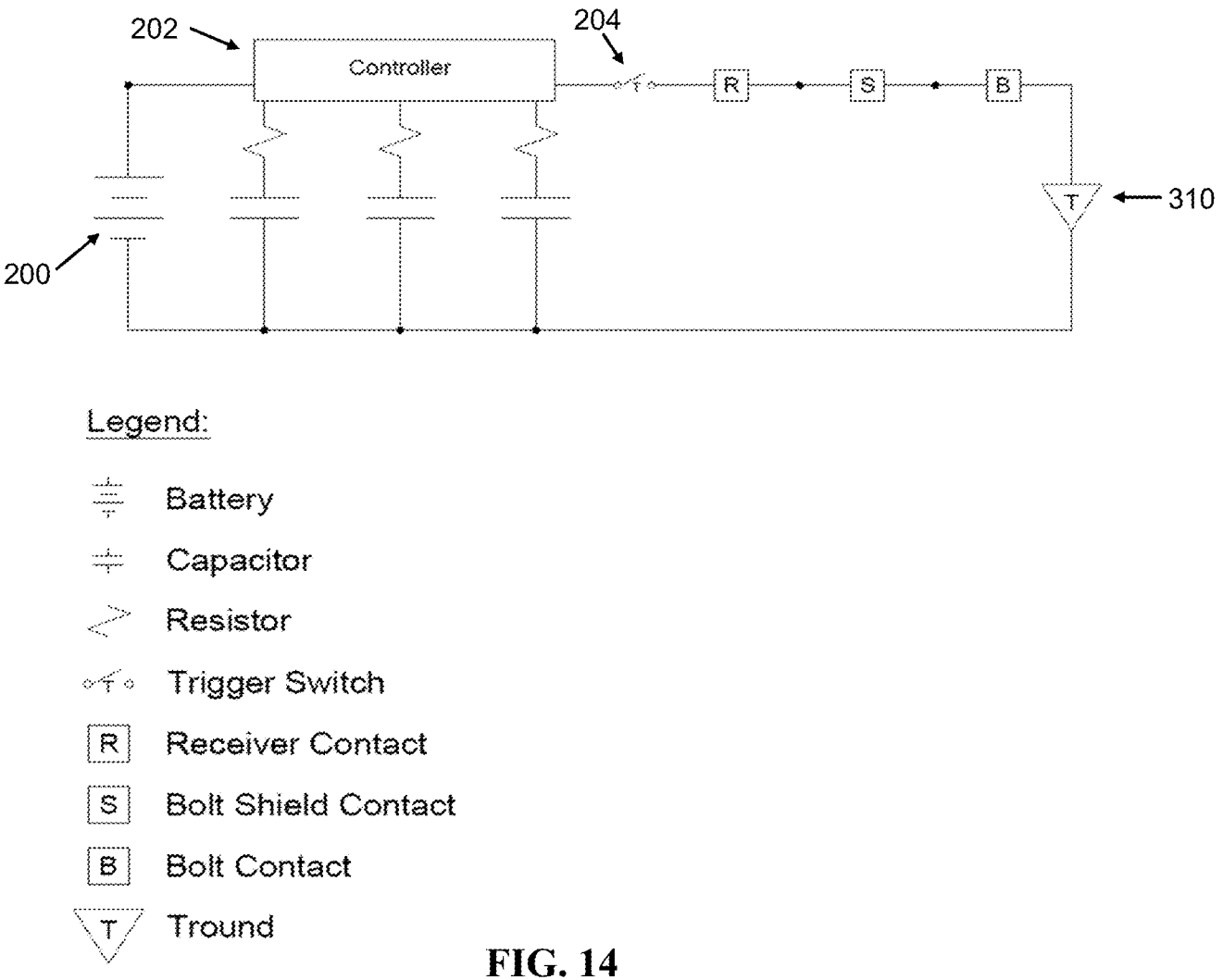
FIG. 14 is a schematic diagram of electrical components for the electrical salvo rifle, in accordance with the present invention.

Additional electrical components may include, without limitation, a power source 200, a controller 202, and a trigger switch 204, a resistor, a wire, a circuitry, and a processor (see, e.g., FIG. 14). Other electrical components known in the art for operation of an electrical firearm may also be utilized. However, in other embodiments, the electrical components can be housed in a more forward position than the buttstock 100, such as directly inside the firearm receiver body 104. Data pertaining to the location and direction of projectile discharge is transmitted for identifying discharge locations and tracking.

As illustrated best in FIG. 14, a power source 200, e.g., a battery, and all associated electronics may be enclosed within a sealed and protected casing that is inserted into the buttstock 110 of the Salvo rifle 102, which is preferably embodied into a rifle. For example, MIL SPEC batteries that can fit into this space are able to generate a charge sufficient for several thousand firing cycles. For example, the rifle may employ the use of one or more salt lithium battery packs ranging from approximately 2-12V, and may have a range of rated capacities. One or more resistor(s) and/or capacitor(s) may also be utilized to ensure that a sufficient charge is available for even the most rapid fire. A controller 202 may also be operably configured to couple with and be electrically coupled to the one or more resistor(s) and/or capacitor (s) in sequence to ensure the rifle is always ready to fire. Said another way, the weapon is powered by a battery and supported by electronics on a circuit board.

Further, the rifle salvo 102 comprises a trigger subassembly 116 that is operatively coupled to the firearm receiver body 104 for actuating discharge of the ammunition 310 through finger action by an operator. The trigger subassembly 116 is operatively connected to multiple electrical firing contacts 500*a-b* that ignite the ammunition. For example, pulling on the trigger subassembly 116 actuates an electric current that ignites an ammunition ignitor 802, or propellant, which fires the ammunition 310. In yet other embodiments, a magazine 118 at the lower end of the firearm receiver body 104 retains the ammunition 310 until pickled up by the bolt 400.

Turning now to FIG. 11, the assembly 100 also includes a connected barrel subassembly 110 that couples to the firearm receiver body 104 through, for example, the plurality of barrel guide cams 1100*a-n*, wherein "n" represents any number greater than one. In some embodiments, only one barrel cam guide may be utilized. The barrel subassembly 110 includes a barrel 112 through which one or more projectiles 800*a-n* for discharge during firing. The barrel subassembly 110 also includes a plurality of barrel guide cams 1100*a-n* that may be disposed on, and extend radially from an exterior surface thereof and at least partially within, respectively, the plurality of cam slots 302*a-n*, which are in front of the bolt 400.

Looking back at FIG. 3, the barrel subassembly 110 has a plurality of barrel guide cams 1100*a-n* on it which interact with the cam slots 302*a-n* on the forward part of an upper receiver of the firearm receiver body 104. This guide cam-cam slot relationship is the means by which the barrel subassembly 110 can slide back-and-forth during discharge and recoil of the Salvo firearm 102. In one possible embodiment, the plurality of barrel guide cams 1100*a-n* are of a plate-like structure. The plate-like structure is generally flat, so as to fit into the cam slots 302*a-n*.

A bolt shield 1102 couples to the barrel 112, which is preferably linear and enables discharging of the ammunition. The bolt shield 1102 serves as a barrier to protect the bolt 400 from contaminants and mechanical complications. In one non-limiting embodiment, the bolt shield 1102 is C-shaped. A barrel face 1104 is interposed between the bolt shield 1102 and the barrel 112. The barrel face 1104 may restrict excessive recoil motion by the bolt 400 by blocking the recoil path after a predetermined path distance. In one non-limiting embodiment, the barrel face 1104 is disc-shaped. However, in other embodiments, different shapes and dimensions may be used.

Figure 4:
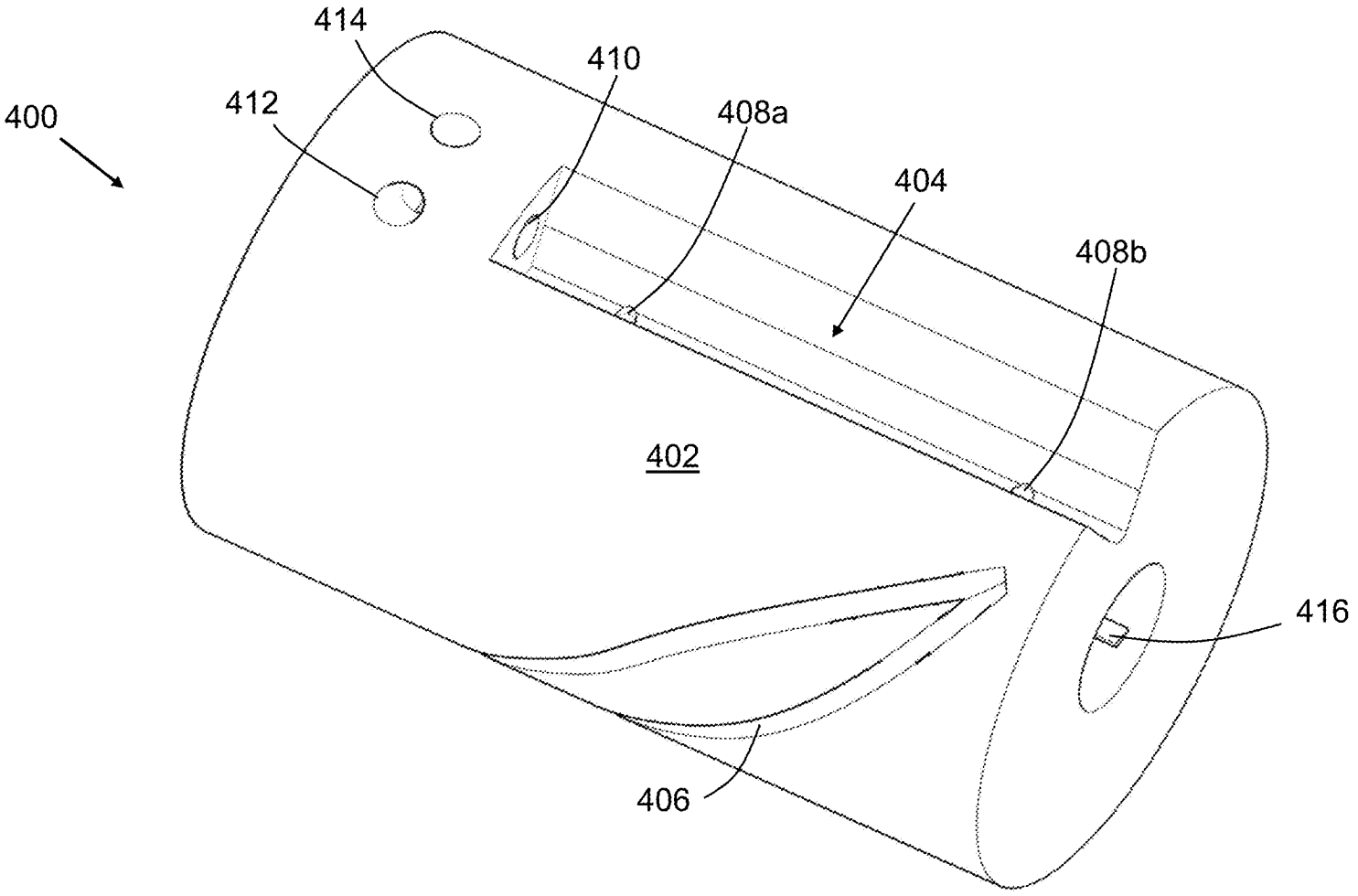
FIG. 4 is a perspective view of an exemplary bolt, in accordance with the present invention.
Figure 5:
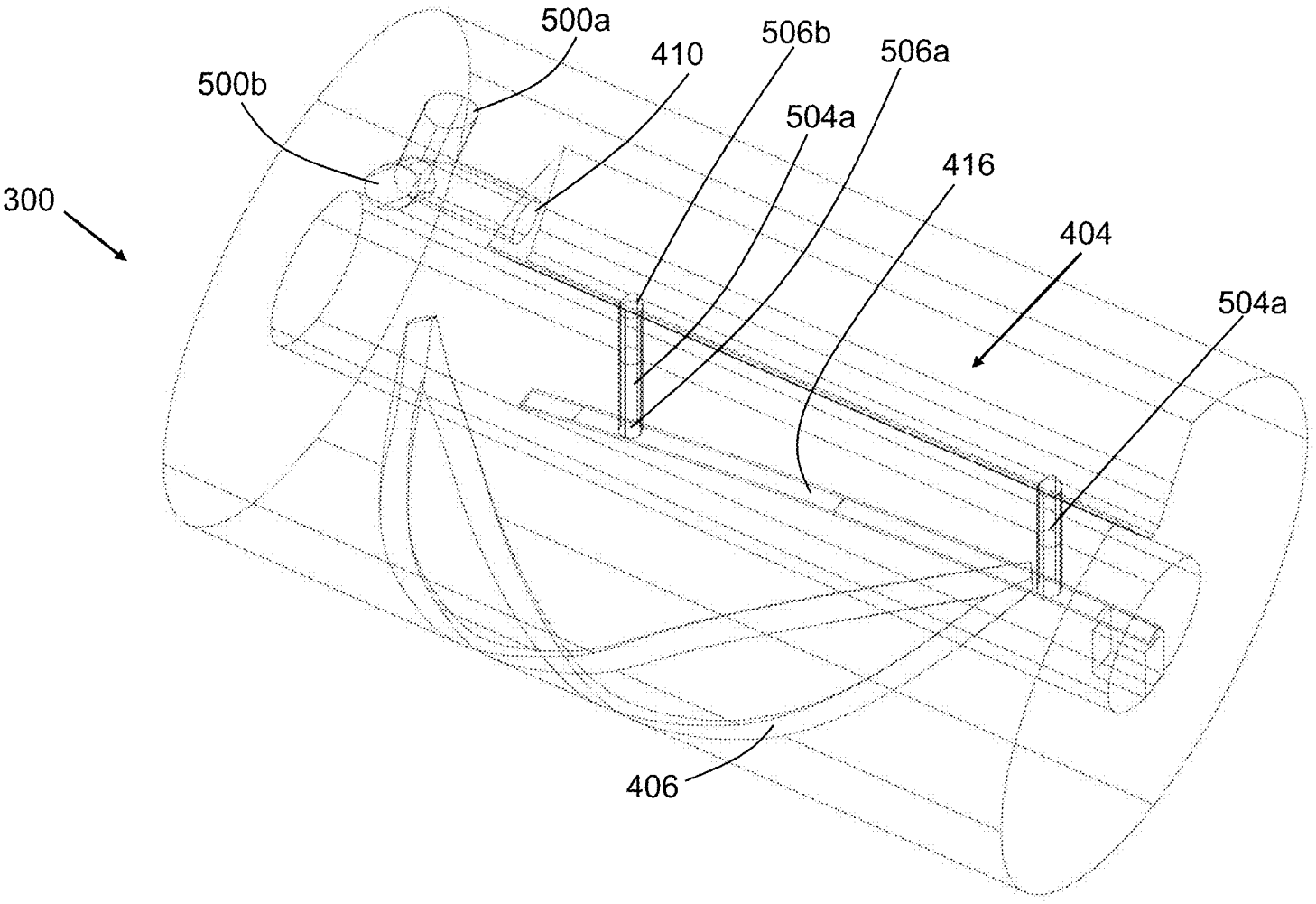
FIG. 5 is a transparent view of the bolt shown in FIG. 4, in accordance with the present invention.

The assembly 100 also comprises a reciprocating, rotating and/or linear-moving bolt 400 that works in conjunction with the firearm receiver body 104 and the barrel subassembly 110. FIGS. 4-5 depict a perspective and transparent view, respectively, of an exemplary bolt 400 employed with the Salvo rifle 102. More specifically, the bolt 400 is uniquely configured to move back-and-forth linearly and rotationally during discharge and recoil action, so as to facilitate loading and unloading of ammunition 310 from the magazine at the lower end of the firearm receiver body 104. This reciprocating motion follows a helical pathway between a firing position 314 and a reloading position 316, described below. In one embodiment, the bolt 400 rotates approximately 90-180° during the discharge and recoil action.

Figure 7:
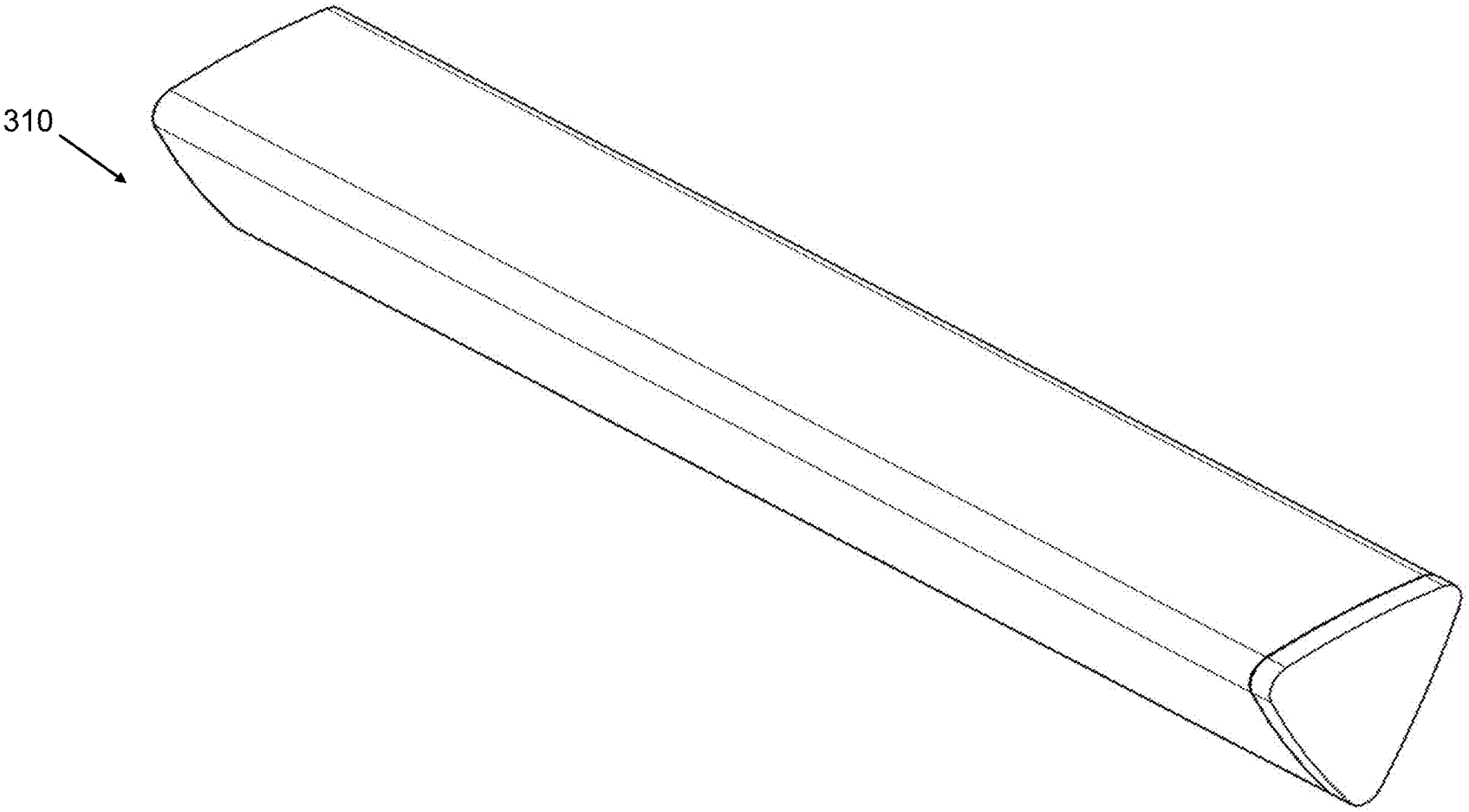
FIG. 7 is a perspective view of an exemplary ammunition in the shape of a tround, in accordance with the present invention.

The bolt 400 has an external surface 402 that forms an ammunition placement zone 404 for retaining and expelling ammunition 310 therefrom. In some embodiments, the ammunition placement zone 404 is of a shape and size configured to contour and at least partially directly coupled to a piece of ammunition 310 on at least two sides and at least one end of the piece of ammunition 310. As illustrated in FIG. 7, the ammunition placement zone 404 may have a V-shape, so as to accommodate a tround.

Figure 8:
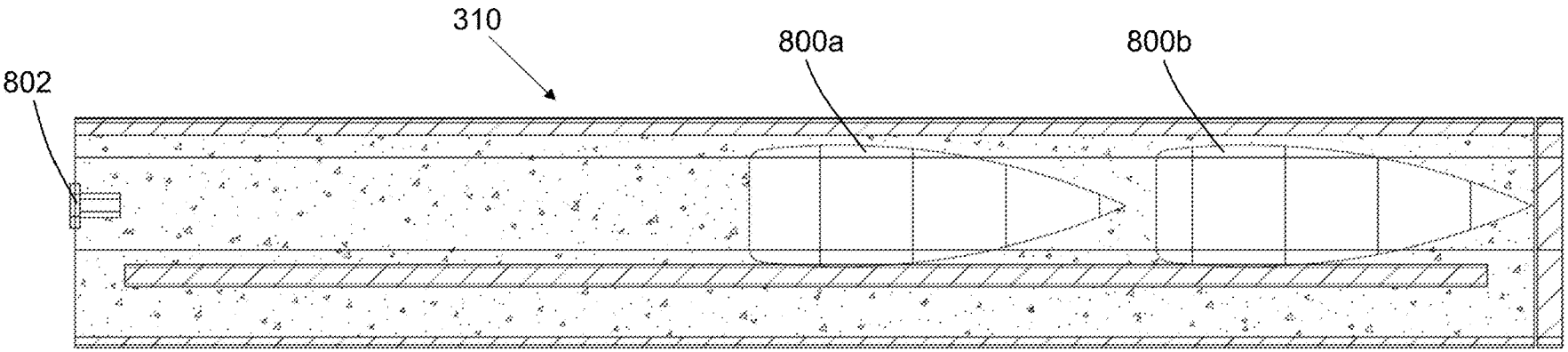
FIG. 8 is a sectioned side view of the tround with projectiles housed therein, in accordance with the present invention.

An exemplary tround is shown in FIG. 8. The tround is (triangular round, or tri-round), is a unique firearms cartridge for use in his open-chamber firearms. The tround is named for its convex triangular shape. The tround allows the firearm's chamber to be open on one side, removing the requirement for reciprocating motion when chambering and ejecting a cartridge. The bolt 400 aligned to receive such a V-shaped tround is shown in FIG. 9. The ammunition 310 is configured to contain multiple projectiles 800*a-n*. The use of multiple projectiles retained inside a single tround is a component of the salvo-type firearm being used for the present invention.

Figure 16:
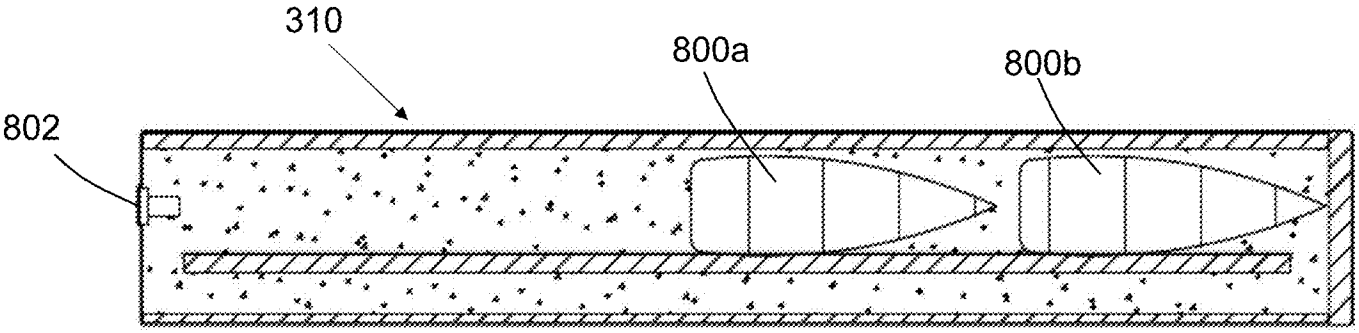
FIG. 16 is a sectioned side view of the tround with projectiles housed therein, in accordance with the present invention.
Figure 17:
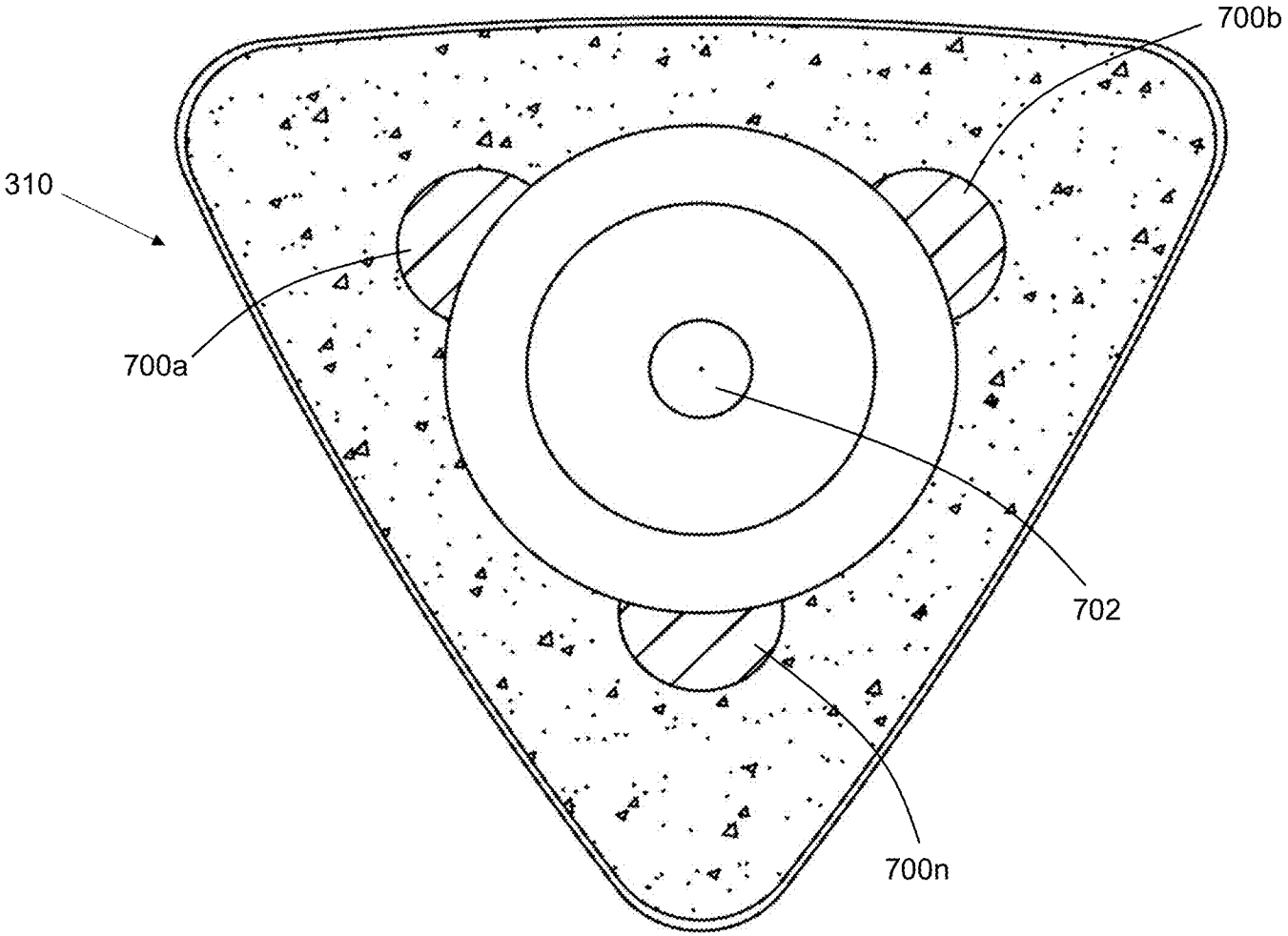
FIG. 17 is a frontal view of the tround, in accordance with the present invention.

As referenced in FIG. 10, the ammunition fitted into the ammunition placement zone 404 is a tround. In some embodiments, the tround contains multiple projectiles 800*a-n* sized to fit into the tround in a telescoping and/or adjacent arrangement and configuration. For example, FIG. 16 illustrates a sectioned side view of the tround with projectiles 800*a-n* housed therein; and FIG. 17 shows a frontal view of the tround. Being a Salvo rifle 102, the projectiles 800*a-n* are configured to simultaneously disengage from the ammunition 310 during firing. This creates a Salvo effect that projects multiple projectiles at the same time during one round of fire. In some embodiments, a firing ignitor 410 is operable at one end of the ammunition placement zone 404. The firing ignitor 410 is in electrical communication with the electrical firing contacts 500*a-b*. The firing ignitor 410 is also selectively engaged with the ammunition 310 disposed in the ammunition placement zone 404.

As FIG. 8 shows, the ammunition 310 comprises an ammunition ignitor 802, which serves as a propellant for the projectiles contained therein. In one embodiment, the firing ignitor 410 aligns with an ammunition ignitor 802 at the back end of the ammunition 310. This allows an electrical current to ignite the firing ignitor 410, which in turn ignites the ammunition 310 to propel the projectiles 800*a-n* through the barrel 112 of the barrel subassembly 110 during discharge of the electrical Salvo rifle 102.

Using stacked projectiles 800*a-n* inside the ammunition 310 allows two or more projectiles to be fired for each perceived recoil of the firearm, i.e., Salvo firings. This is well known to increase hit probability because projectile drop and gyroscopic drift will increase the impact area. This is especially true when firing upon fleeting targets. In another embodiment, multiple barrels can be used with multiple projectiles arranged adjacent to each other in the tround as opposed to being stacked. Salvo firing also improve the suppressive fire effects. Multiple rounds impacting more accurately on target create a greater suppressive effect on an enemy than single shots or automatic but inaccurate fire.

Furthermore, extraction of the ammunition 310 from the ammunition placement zone 404 is also simplified, as the bolt 400 may use a very simple leaf spring and centrifugal force to eject spent projectiles 800*a-n* from the ammunition 310. This is a much less failure prone method than the current art. For this purpose, the bolt 400 comprises an ejector spring 416 coupled thereto. In one non-limiting embodiment, the ejector spring 416 comprises a leaf spring.

Figure 6:
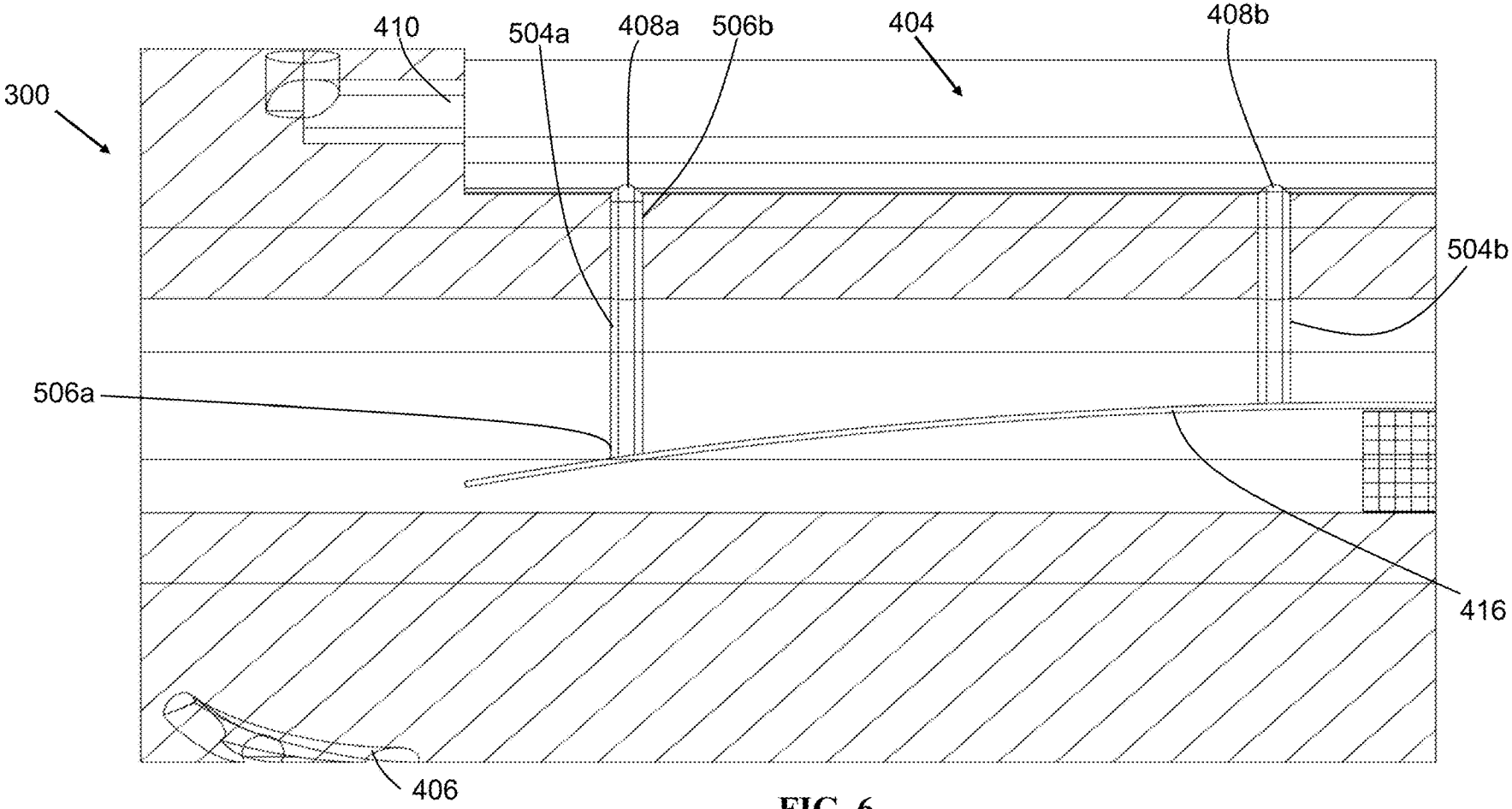
FIG. 6 is a sectioned side view of the bolt shown in FIG. 4, in accordance with the present invention.

As can be seen the sectioned side view of the bolt 400, shown in FIG. 6, at least one ejector prong 504*a*, 504*b* is at least partially disposed within at least one prong hole 408*a*, 408*b* that form in the bolt 400. The prong hole 408*a-b* have one end 506*a* directly coupled to the ejector spring 416 and another end 506*b* operably configured to protrude into the ammunition placement zone 404 with biasing force provided by the ejector spring 416.

Referring to FIG. 5, the approximate centroid or center of mass of the bolt 400 may include an ejector spring 416, e.g., a leaf spring, with two ejector prongs, e.g., prongs 504*a*, 504*b*, operably configured to protrude into an ammunition placement zone defined by the bolt 400. The one or more prongs 504*a-b* project through respective ejector prong holes 408*a*, 408*b* defined on the bolt 400 and into the ammunition placement zone 404 for assisting in ejecting spent projectiles 800*a-n* from the ammunition 310 and/or the ammunition shells. The spaced-apart disposition of the prongs 504*a-b* allows for greater flexibility for the ejector spring 416.

Figure 12:
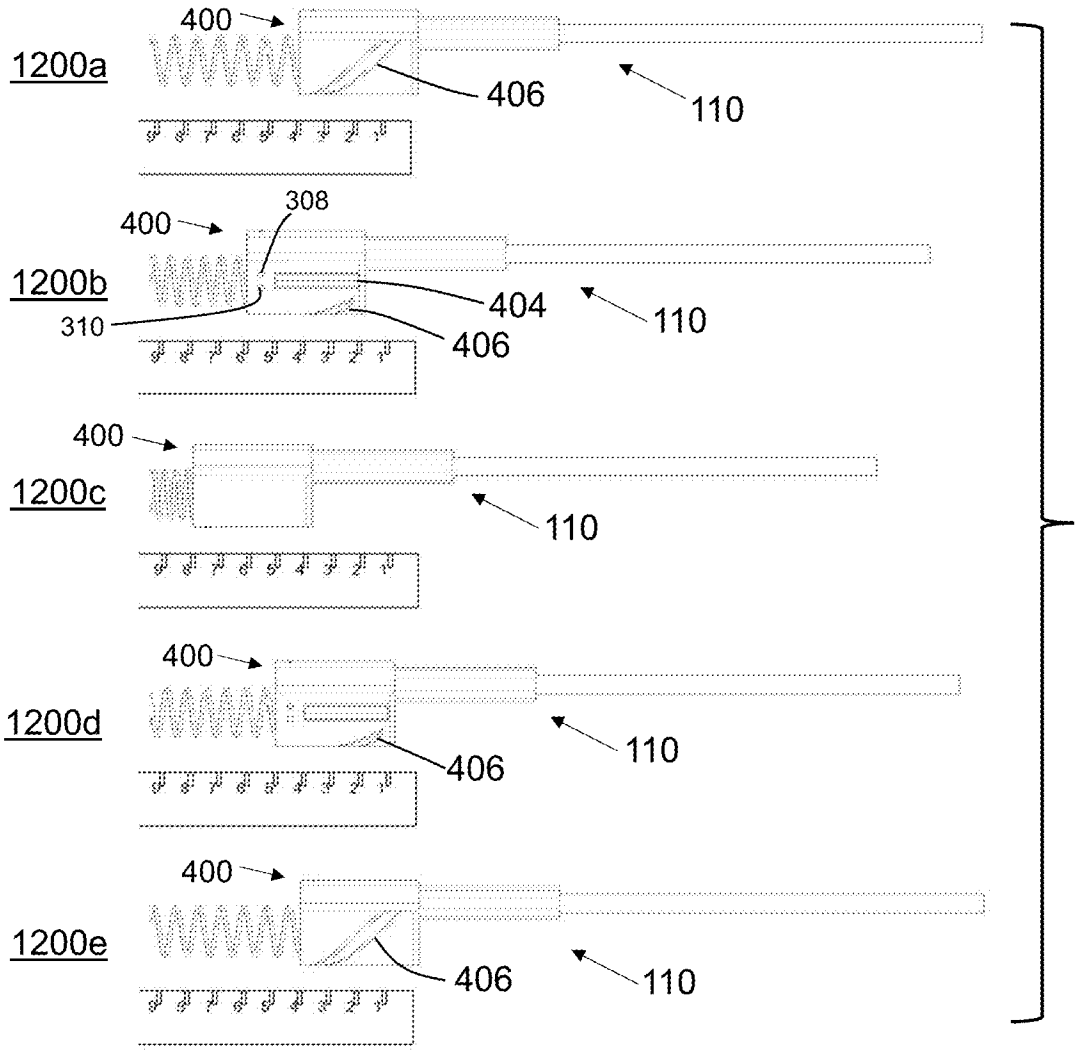
FIG. 12 is a side view of the bolt rotatably and longitudinally sliding along a bolt translation path in a helical path, showing a firing position and a recoil position, in accordance with the present invention.

The bolt 400 is also defined by a cam track 406 disposed and defined thereon. In FIG. 12, the bolt 400 is illustrated as rotatably and longitudinally sliding along a bolt translation path 312, which may be helical and/or otherwise curvilinear, as the bolt cam follower 306 of the firearm receiver body 104 rides the cam track 406 of the bolt 400. While following the bolt translation path 312, the bolt 400, through the cam track 406 engagement with the bolt cam follower 306, is carried between a firing position 314 and a reloading position 316, described below.

Figure 13:
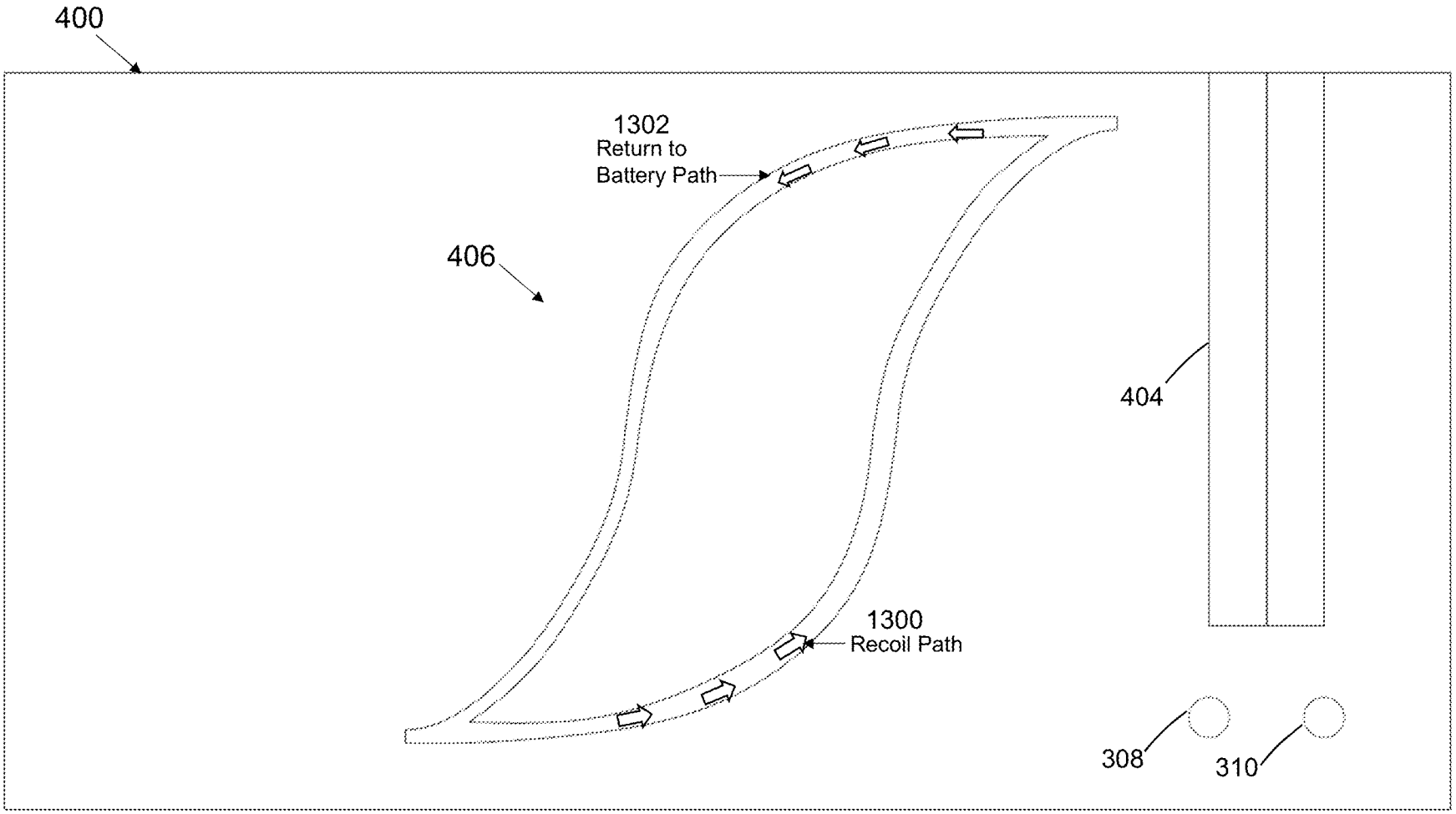
FIG. 13 is a top view of the bolt axially displaced during discharge and recoil, where the bolt follows a recoil cam track path and a return cam track path, in accordance with the present invention.

Looking now at FIG. 13, the at least one bolt cam follower 306 that projects from the inner surface 304 of the sidewall 108 for the firearm receiver body 104 is disposed within the cam track 406 of the bolt 400. As the bolt 400 is axially displaced during discharge and recoil, the bolt 400 follows a recoil cam track path 1300 and a return cam track path 1302. Each path 1300, 1302 follows a curvilinear shape different than one another. In one possible embodiment, the recoil cam track path 1300 orients the ammunition placement zone 404 of the bolt 400 to align with the ejection port 122 of the firearm receiver body 104.

Figure 15:
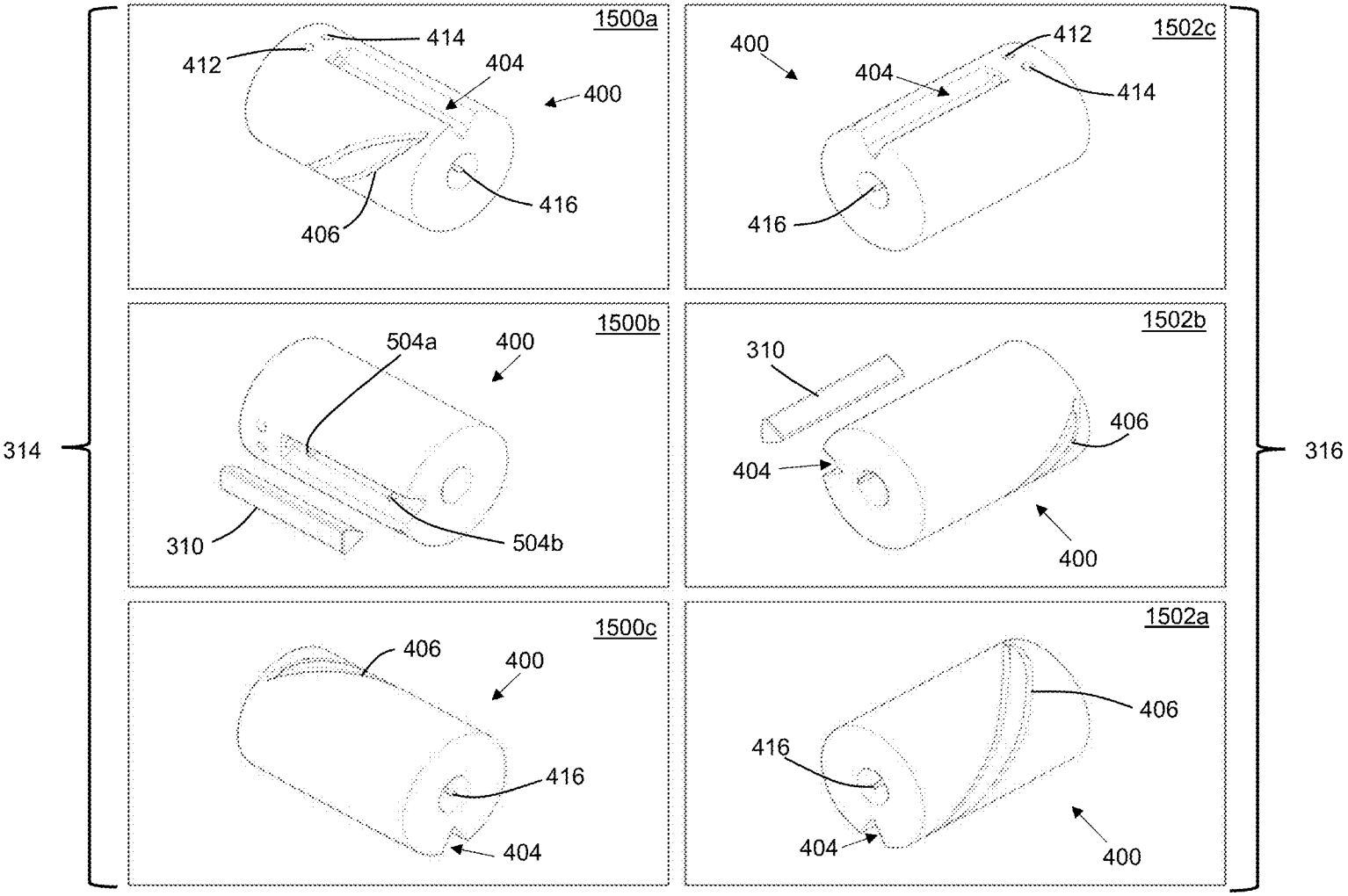
FIG. 15 is a side view of the bolt being carried between a firing position and a reloading position, in accordance with the present invention.

Various exemplary positions of the bolt 400, with and without a piece of ammunition 310 retained and housed therein) along the bolt translation path can be specifically seen in FIG. 15. The bolt translation path may be reciprocating, i.e., operable to move back-and-forth from an end position to a start position and rotational. The bolt translation path may be inversely symmetrical or symmetrical. The bolt 400 may be operable to move in the longitudinal and rotational direction using a cam guide disposed within a cam guide of the bolt. Beneficially, however, the bolt 400 may be operable to return to the same position as it was before discharge, after discharge and recoil, and in a single rotational motion without stopping. In other potential embodiments, the bolt 400 may stop at a position of reloading (as best shown in FIG. 12, position 1200*c*), and then require user intervention to move the bolt back to the firing position.

In other embodiments, the bolt 400 may recoil longitudinally as is normal. However, unlike all other systems, the bolt 400 may rotate with respect to its longitudinal axis 180° during the recoil and return stroke (as best seen represented and depicted in FIG. 12). The rotation may take place inside an interstitial space created by the bolt shield, bolt face, and receiver (wherein all of said components or other components of the firearm may be of a substantially rigid material, e.g., carbon steel, nickel, etc.). The longitudinal rotation is guided by a cam using separate cam tracks on both the recoil and return. The recoil may be compensated, in part, by using the mass of the barrel subassembly. The design allows different bolt and barrel assemblies to be used within the same receiver.

Said another way, the bolt 400 may be considered to be modular, in that it may change its mass depending on the desired ammunition. Said differently, different loads (ammunition) can be used within the same receiver and the mass of the barrel and bolt assemblies can be varied to accommodate the recoil forces. Further, a length of the barrel can also be altered. As such, there may be three (3) moving parts (barrel, bolt, ejector spring) compared to, for example, a fraction of parts in the AR-15 bolt assembly. As such, an open chamber bolt is disclosed that may move both rotationally and longitudinally. In one embodiment (as best shown in FIGS. 11-12), the bolt shield 1102 includes a lower surface 1108 of a C-shape that superimposes the bolt entirely along the bolt translation path.

As discussed above, the assembly 100 is in essence, an electrical Salvo firearm. Thus, one or more electrical firing contacts 500*a*, 500*b* on the external surface of the bolt 400 are disposed proximal to the ammunition placement zone 404. The electrical firing contacts 500*a-b* are operatively connected to the other electrical components, e.g., a battery 200, controller 202, trigger switch 204, so as to actuate discharge of the assembly 100. And when discharged, the bolt 400 is forcibly urged to rotatably and longitudinally translate along a bolt translation path 312 defined by the at least one bolt cam follower 306 disposed within the cam track 406 of the bolt 400.

In one possible embodiment, an electrical inlet 412 and an electrical outlet 414 (or contacts 412, 414) are formed at one end of the bolt 400 to complete a circuit and/or otherwise transfer electrical current. The electrical inlet and outlet 412, 414 may be in electrical communication with the electrical firing contacts 500*a-b*, as discussed below. In another embodiment, the assembly 100 provides an electrical inlet 1106*a* and an electrical outlet 1106*b* formed in the bolt shield 1102. The inlet and outlet 1106*a-b* are in communication with the electrical inlet 412 and the electrical outlet 414 formed at one end of the bolt 400. The electrical firing contacts 500*a-b* carry electrical current to the inlets 412, 1106*a* and outlets 414, 1106*b* for actuating discharge of the ammunition 310.

An exemplary electrical schematic for the assembly 100 is depicted in FIG. 14. Exemplary supporting technology background and component structure, nomenclature, and interrelatedness can be found in Dardick, U.S. Pat. No. 3,503,300, Dardick, U.S. Pat. No. 4,478,892, Dardick, U.S. Pat. No. 3,041,939, Dardick, U.S. Pat. No. 3,434,380, Dardick, U.S. Pat. No. 3,855,931, Dardick et al., U.S. Pat. No. 9,163,900, Dardick, U.S. Pat. No. 2,847,784, the entirety of the same are incorporated herein by reference.

While following the bolt translation path 312, the bolt 400 is carried between a firing position 314 and a reloading position 316. This reciprocating pathway occurs as the bolt cam follower 306 carries the cam track 406. As illustrated in FIG. 15, the bolt 400 rotates in both directions while being carried between a firing position 314 and a reloading position 316. The firing position 314 is configured, such that at least one of the electrical firing contacts 500*a-b* is disposed on the external surface of the bolt 400. The firing position 314 is also configured, such that the electrical firing contacts 500*a-b* are electrically coupled to the electronic controller 202 and with the ammunition placement zone 404 axially aligned with the barrel chamber 114.

Said another way, the firing position 316 of the bolt translation path 312 includes the bolt shield 1102 superimposing the ammunition placement zone 404. The bolt shield 1102, thus, serves as a barrier to prevent the bolt 400 from recoiling beyond a predetermined point along the barrel subassembly 110. FIG. 15 shows an initial position 1500*a* in which the bolt 400 rests in the firing position with the ammunition initially oriented upwardly. As the discharge occurs, a position 1500*b* occurs, whereby the bolt rotates 45°, causing the ejector spring to expel the ammunition 310. A final position 1500*c* shows the bolt fully turned over in anticipation for the reloading position 316.

The bolt 400 also recoils to a reloading position 316. The reloading position 316 is configured, such that at least one of the electrical firing contacts 500*a-b* is disposed on the external surface of the bolt 400 and the electrical firing contacts electrically uncoupled from the electronic controller 202. Said another way, the reloading position 314 is oriented approximately 90° to 180°, with respect to the firing position 316. Continuing with FIG. 15, the reloading position 316 finds the bolt 400 recoiling in an empty position 1502*a* ready to accept the ammunition from the magazine 118. The next position 1502*b* illustrates the ammunition 310 entering the ammunition placement zone 304 of the bolt. A final position 1502*c* shows the new ammunition in place ready for firing again.

In some embodiments, the bolt 400 includes one or more electrical pathways 500*a-b* can also be seen depicted. The electrical pathways 500*a-b* provide channels where electrical connectors or connections may be established between a power source, e.g., battery, and other electrical components of the firearm, e.g., trigger switch, receiver contact, bolt shield contact, bolt contact. The battery may also be used to power ancillary items such as optics or laser sights. The rails on the receiver and fore stock can be connected to the battery for this purpose. Further, a hand powered generator can be incorporated into the pistol grip to create power as well.

The salvo rifle 102, being electrical, generates an electric current to ignite a propellant, which fires multiple projectiles 800*a-n* from a single piece of ammunition 310. FIGS. 7 and 8 depicts a sectioned view and a perspective view, respectively, of an exemplary ammunition 310 employed with the salvo rifle 102. The ammunition 310 can be a tround having a convex triangular shape, for example. The ammunition 310 may include one or more stacked and telescoped projectiles 800*a*, 800*b*, 800*n* housed therein for simultaneous discharge.

Said another way, an electrical charge is generated from the power source 200, through the upper receiver 106, to the bolt shield 1102, to the bolt 400 and then finally to the ammunition 310. The electrical input 701 and output 712 on the bolt shield 1102 is operably configured to align with an input 308 and an output 310 on the bolt 400 in a firing or static position along a bolt translation path. The bolt 400 may also include a reloading position along the bolt translation path. In the reloading position, the ammunition 310 can be discharged from the ammunition placement zone 304 and/or another piece of ammunition may be reloaded (this position may include the ejectment and reloading occurring simultaneously or after one another). More specifically, as seen in FIG. 12, the combined barrel 112, barrel face 1104, and bolt shield 1102 are used to seal (substantially watertight and/or hermetically) the open chamber of the bolt 400. And the bolt 400 rotates under the bolt shield 1102. Again, the mass of the barrel subassembly 110 to accommodate different ammunition types is effectuated while using the same firearm receiver.

Electric firing, as described herein, also has inherent accuracy advantages. Prior art has demonstrated that electrical firing reduces lock time by over 99%. This means that an electronically fired rifle will have the projectile leaving the muzzle at the same time that a simultaneously fired traditional rifle has the firing pin striking the primer. Further, reducing the mechanical linkages gives a commensurate reduction in mechanical kinetics which negatively impact accuracy. Barrel resonance is also reduced through use of the present invention. In this design the barrel has only a single attachment point. Known prior art has demonstrated that a single point of contact reduces barrel resonance which increases accuracy. Mechanical simplicity is also increased through use of the present invention, as the present invention includes a design vastly reducing the number of failure prone parts.

For example, the bolt group has only two (2) pieces, the bolt 400 and the ejector spring 416. The trigger group also has similar advantages, as gas impingement is eliminated and there is no gas diversion which greatly reduces carbon build up and fouling. Additionally, there is more tolerance for debris. Further, the tround case, unlike brass casings, is flexible. This means that if debris is introduced into the chamber it is much less likely to cause a stoppage. There is also less likely to involve cook off, as the tround case acts as a heat sink. Before the heat generated from firing can be transmitted to the chamber the cartridge is ejected. This heat sink reduces heat build-up within the chamber. Slam fires are also eliminated through use of the present invention. The elimination of a firing pin eliminates slam fires. Trounds are also more reliable than current art, as trounds do not suffer from cartridge separation, stubbed cartridges, hard lock, dented casings, or double loads.

As such, the figures depict how a barrel subassembly 110 interacts with the bolt 400 to achieve unique firing results. A longitudinal rotational path is generated with the bolt and is guided by a cam using separate cam tracks on both the recoil and return (best seen in FIG. 13). This causes the bolt to rotate and recoil at the same time in a "helical" fashion. The recoil is compensated by using the mass of the barrel subassembly, bolt and the buffer spring.

Said differently, the portion of the image to the right in FIG. 13 depicts the open chamber with the two ejector prong ports. Beneath that are the input and output electrical contacts. The cam tracks are shown with arrows in opposing directions—a recoil path, and a return to battery path. The cam that acts upon it is located on the lower receiver 120 just to the rear and left of the ammunition feed point. The arrows at the bottom of the image show the cam track used in recoil. The track allows for a moment of rest after firing to ensure that the projectiles enter the barrel and gasses expelled prior to the turning motion. The arrows to the top of the image show the path for returning the system to battery. The straight part of the track allows the next cartridge to be stripped and properly seated in the chamber. Then the different pathway ensures that the cartridge is not placed directly over the ejection port preventing ejection.

The mass of the barrel can be altered to accommodate different ammunition. Additionally, the design allows different bolt and barrel assemblies to be used within the same receiver (See FIG. 11). Thus, the user can change the ammunition type fired in seconds while still using the same rifle. Cartridges are fired by electrical ignition. The electrical path in the preferred embodiment is through the firearm receiver body 104, bolt shield 1102, bolt 400, and to the ammunition 310. However, there are a multitude of other pathways such as through the rear of the bolt 400 or the lower receiver 120. Ejection may be partially or wholly effectuated through centrifugal force of the bolt and/or the ejector spring 416. In another embodiment the positive air pressure created by displaced air during recoil is vented through the ports to cause ejection of the spent cartridge 600*a-n*.

Through the entire operation the front of the bolt may be in continuous direct contact with the barrel face. As such, the bolt rotates inside a space created by the receiver, barrel face and bolt while the bolt may be in continuous contact with the face of the barrel. The cam system ensures that the bolt travels on a different path during recoil and return to battery. This ensures that only expended cartridges are ejected, while live trounds are retained in the ammunition placement zone 404.

Some of the above-referenced figures and specifically FIG. 12 show a specific and exemplary longitudinal rotation path of the bolt along the bolt translation path. However, two or more positions may occur in succession or may occur or be executed concurrently or with partial concurrence in some embodiments. Certain steps may also be omitted for the sake of brevity. The top drawing portion 1200*a* shows the bolt 400 in a battery position. Here, the bolt is underneath the bolt shield and forced by the buffer spring against the barrel face. The chamber is at the uppermost position. All electrical contacts are now aligned.

Continuing, the drawing portion 1200*b* shows the bolt 400 in recoil. The bolt retracts towards the buttstock 110, but is still in the same position relative to the barrel subassembly 110. The chamber is now turned to the ejection position. The third drawing portion 1200*c* shows the bolt 400 at full recoil. The fourth drawing portion 1200*d* shows the bolt 400 returning to battery. The chamber is now in a different position than the ejection position due to the differing cam tracks. As a result, the new piece of ammunition 310 will not eject as it is not over the ejection port 122. The fifth drawing portion 1200*e* shows the bolt 400 returned to battery or ignition position.

Additional capabilities can be added beyond what is necessary for firing the weapon. For example, an accelerometer can be fitted. This would detect when the weapon was fired. That information may be stored locally on a non-transitory memory housed by the firearm or may be instantly and automatically transmitted to a headquarters communicatively coupled to the firearm using, for example, a network interface. The network interfaces may include one or more network interface cards (NIC) or a network controller.

In some embodiments, the network interface may include a personal area network (PAN) interface. The PAN interface may provide the capability for the firearm to communicate over a network using a short-range communication protocol, for example, a Bluetooth communication protocol. The PAN interface may permit the firearm to connect wirelessly to another electronic device via a peer-to-peer connection. In some embodiments, the network interface may also include a local area network (LAN) interface. The LAN interface may be, for example, an interface to a wireless LAN, such as a Wi-Fi network. The range of the LAN interface may generally exceed the range available via the PAN interface. Typically, a connection between two electronic devices via the LAN interface may involve communication through a network router or other intermediary device.

Additionally, the network interface may include the capability to connect to a wide area network (WAN) via a WAN interface. The WAN interface may permit a connection to, for example, a cellular mobile communications network. The WAN interface may include communications circuitry, such as an antenna coupled to a radio circuit having a transceiver for transmitting and receiving radio signals via the antenna from the firearm to another electronic device. The radio circuit may be configured to operate in a mobile communications network, including but not limited to global systems for mobile communications (GSM), code division multiple access (CDMA), wideband CDMA, WCDMA, and the like.

The electronic device may also include a near field communication (NFC) interface. The NFC interface may allow for extremely close-range communication at relatively low data rates (e.g., 424 kb/s). The NFC interface may take place via magnetic field induction, allowing the NFC interface to communicate with other NFC interfaces located on other mobile computing devices or to retrieve information from tags having radio frequency identification (RFID) circuitry. The NFC interface may enable initiation and/or facilitation of data transfer from the firearm to another computing device with an extremely close range (e.g. 4-25 centimeters). Such devices may be utilized to read the codes associated with RFID tags having information encoded therein to implement features of the present disclosure.

In this manner, the location of the action and the direction of the firing can also be transmitted. This would alert commanders that troops are in action instantly. Further, this information may allow commanders to identify blue-on-blue events earlier than would otherwise be possible. Also, supporting fires or orders to other units can be arranged at a faster tempo than in the past.

In conclusion, the electronic firing rifle assembly 100 includes an electrical salvo rifle 102 that is operable through electrical means to efficiently discharge a salvo of projectiles 800*a-n*. The assembly 100 includes a firearm receiver body that provides housing for internal action components, and is defined by an inner surface having cam slots. The assembly 100 also includes a barrel subassembly having a barrel and a plurality of barrel guide cams 1100*a-n* extending radially within the cam slots formed in the firearm receiver body 104.

Further, the assembly 100 also includes a reciprocating bolt 400 defined by has an ammunition placement zone 404 for retaining ammunition, such as a round. A leaf spring ejects the ammunition after discharge of projectiles. The bolt 400 is defined by a cam track that allows the bolt to rotatably and longitudinally reciprocate along a bolt translation path in a helical path. Data pertaining to the location and direction of projectile discharge is transmitted for identifying discharge locations and tracking.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. An electronic firing rifle assembly comprising:

a firearm receiver body defining an ejection port and with a sidewall defining an internal enclosed channel and a plurality of cam slots independently defined and disposed on an inner surface of the sidewall of the firearm receiver body and at least one bolt cam follower protruding from the inner surface of the sidewall, the firearm receiver body housing a power source electrically coupled to an electronic controller and including an electronic trigger switch coupled thereto;

a barrel subassembly having a barrel defining a barrel chamber and a plurality of barrel guide cams disposed on and extending radially from an exterior surface thereof and at least partially within, respectively, the plurality of cam slots;

a bolt shield coupled to the barrel and with a barrel face interposed between the bolt shield and the barrel; and a bolt:

having an external surface defining an ammunition placement zone and a cam track disposed and defined thereon, with the at least one bolt cam follower disposed within the cam track of the bolt, and with a recoil cam track path and a return cam track path each of a curvilinear shape different than one another;

with a plurality of electrical firing contacts, including a first electrical firing contact disposed proximal to the ammunition placement zone and a second of the plurality of electrical firing contacts disposed on the external surface of the bolt;

operably configured to rotatably and longitudinally translate along a bolt translation path defined by the at least one bolt cam follower disposed within the cam track of the bolt to have:

a firing position with at least one of the electrical firing contacts disposed on the external surface of the bolt and the electrical firing contacts electrically coupled to the electronic controller and with the ammunition placement zone axially aligned with the barrel chamber, and a reloading position with the at least one of the electrical firing contacts disposed on the external surface of the bolt and the electrical firing contacts electrically uncoupled from the electronic controller.

2. The electronic firing rifle assembly according to claim 1, wherein the bolt further comprises:

an ejector spring coupled thereto; and at least one ejector prong at least partially disposed within at least one prong hole defined by the bolt and having one end directly coupled to the ejector spring and another end operably configured to protrude into the ammunition placement zone with biasing force provided by the ejector spring.

3. The electronic firing rifle assembly according to claim 2, wherein:

The ejector spring comprises a leaf spring.

4. The electronic firing rifle assembly according to claim 1, wherein:

the ammunition placement zone is of a shape and size configured to contour and at least partially directly coupled to a piece of ammunition on at least two sides and at least one end of the piece of ammunition.

5. The electronic firing rifle assembly according to claim 4, wherein:

the ammunition comprises an ammunition ignitor.

6. The electronic firing rifle assembly according to claim 4, wherein:

the ammunition comprises a tround.

7. The electronic firing rifle assembly according to claim 6, wherein:

the tround contains one or more projectiles.

8. The electronic firing rifle assembly according to claim 1, wherein:

the cam slots are defined by the firearm receiver body are of a linear orientation; and the plurality of barrel guide cams are of a plate-like structure.

9. The electronic firing rifle assembly according to claim 1, wherein:

the firing position of the bolt translation path includes the bolt shield superimposing the ammunition placement zone.

10. The electronic firing rifle assembly according to claim 9, wherein:

the reloading position is oriented approximately 90 degrees to 180 degrees with respect to the firing position.

11. The electronic firing rifle assembly according to claim 1, wherein:

the recoil cam track path orients the ammunition placement zone of the bolt to align with the ejection port of the firearm receiver body.

12. The electronic firing rifle assembly according to claim 1, wherein:

the bolt shield includes a lower surface of a C-shape that superimposes the bolt entirely along the bolt translation path.

13. The electronic firing rifle assembly according to claim 1, further comprising:

a buttstock housing the power source electrically coupled to the electronic controller and including the electronic trigger switch coupled thereto.

14. The electronic firing rifle assembly according to claim 4, further comprising:

a firing ignitor disposed at one end of the ammunition placement zone, the firing ignitor being in electrical communication with the electrical firing contacts, the firing ignitor further being selectively engaged with the ammunition when disposed in the ammunition placement zone.

15. The electronic firing rifle assembly according to claim 1, further comprising:

an electrical inlet and an electrical outlet formed at one end of the bolt, the electrical inlet and outlet being in communication with the electrical firing contacts.

16. The electronic firing rifle assembly according to claim 15, further comprising:

an electrical inlet and an electrical outlet formed in the bolt shield, the inlet and outlet being in communication with the electrical inlet and the electrical outlet formed at one end of the bolt.

17. The electronic firing rifle assembly according to claim 1, further comprising:

a trigger subassembly coupled to the firearm receiver body, and operatively connected to the electrical firing contacts.

18. The electronic firing rifle assembly according to claim 1, further comprising:

an accelerometer operatively connected to a non-transitory memory and a network.

19. An electronic firing rifle assembly comprising:

a firearm receiver body defining an ejection port and with a sidewall defining an internal enclosed channel and a plurality of cam slots independently defined and disposed on an inner surface of the sidewall of the firearm receiver body and at least one bolt cam follower protruding from the inner surface of the sidewall, the firearm receiver body housing a power source electrically coupled to an electronic controller and including an electronic trigger switch coupled thereto;

a barrel subassembly:

having a barrel defining a barrel chamber and a plurality of barrel guide cams disposed on and extending radially from an exterior surface thereof and at least partially within, respectively, the plurality of cam slots;

a bolt shield coupled to the barrel and with a barrel face interposed between the bolt shield and the barrel; and a bolt:

having an external surface defining an ammunition placement zone and a cam track disposed and defined thereon, with the at least one bolt cam follower disposed within the cam track of the bolt, and with a recoil cam track path and a return cam track path each of a curvilinear shape different than one another, the recoil cam track path orienting the ammunition placement zone of the bolt to align with the ejection port of the firearm receiver body, the ammunition placement zone being of a shape and size configured to contour and at least partially directly coupled to a piece of ammunition on at least two sides and at least one end of the piece of ammunition;

an ejector spring coupled to the bolt;

at least one ejector prong at least partially disposed within at least one prong hole defined by the bolt and having one end directly coupled to the ejector spring and another end operably configured to protrude into the ammunition placement zone with biasing force provided by the ejector spring;

one or more electrical firing contacts disposed proximal to the ammunition placement zone, and the one or more electrical firing contacts disposed on the external surface of the bolt;

whereby the bolt is operably configured to rotatably and longitudinally translate along a bolt translation path defined by the at least one bolt cam follower disposed within the cam track of the bolt to have:

a firing position with at least one of the electrical firing contacts disposed on the external surface of the bolt and the electrical firing contacts electrically coupled to the electronic controller and with the ammunition placement zone axially aligned with the barrel chamber, and a reloading position with the at least one of the electrical firing contacts disposed on the external surface of the bolt and the electrical firing contacts electrically uncoupled from the electronic controller, whereby the firing position of the bolt translation path includes the bolt shield superimposing the ammunition placement zone, and the reloading position is oriented approximately 90 degrees to 180 degrees with respect to the firing position;

an electrical inlet and an electrical outlet formed at one end of the bolt, the electrical inlet and outlet being in communication with the electrical firing contacts; and an electrical inlet and an electrical outlet formed in the bolt shield, the electrical inlet and outlet being in communication with the electrical inlet and the electrical outlet formed at one end of the bolt.

20. An electronic firing rifle assembly comprising:

a firearm receiver body defining an ejection port and with a sidewall defining an internal enclosed channel and a plurality of cam slots independently defined and disposed on an inner surface of the sidewall of the firearm receiver body and at least one bolt cam follower protruding from the inner surface of the sidewall, the firearm receiver body housing a power source electrically coupled to an electronic controller and including an electronic trigger switch coupled thereto;

a barrel subassembly:

having a barrel defining a barrel chamber and a plurality of barrel guide cams disposed on and extending radially from an exterior surface thereof and at least partially within, respectively, the plurality of cam slots;

a bolt shield coupled to the barrel and with a barrel face interposed between the bolt shield and the barrel; and a bolt:

having an external surface defining a tround placement zone and a cam track disposed and defined thereon, with the at least one bolt cam follower disposed within the cam track of the bolt, and with a recoil cam track path and a return cam track path each of a curvilinear shape different than one another, the recoil cam track path orienting the tround placement zone of the bolt to align with the ejection port of the firearm receiver body, the tround placement zone being of a shape and size configured to contour and at least partially directly coupled to a tround on at least two sides and at least one end of the tround;

a leaf spring coupled to the bolt;

at least one ejector prong at least partially disposed within at least one prong hole defined by the bolt and having one end directly coupled to the leaf spring and another end operably configured to protrude into the tround placement zone with biasing force provided by the leaf spring;

one or more electrical firing contacts disposed proximal to the tround placement zone, and the one or more electrical firing contacts disposed on the external surface of the bolt;

whereby the bolt is operably configured to rotatably and longitudinally translate along a bolt translation path defined by the at least one bolt cam follower disposed within the cam track of the bolt to have:

a firing position with at least one of the electrical firing contacts disposed on the external surface of the bolt and the electrical firing contacts electrically coupled to the electronic controller and with the tround placement zone axially aligned with the barrel chamber, and a reloading position with the at least one of the electrical firing contacts disposed on the external surface of the bolt and the electrical firing contacts electrically uncoupled from the electronic controller, the firing position of the bolt translation path includes the bolt shield superimposing the tround placement zone, and the reloading position is oriented approximately 90 degrees to 180 degrees with respect to the firing position;

an electrical inlet and an electrical outlet formed at one end of the bolt, the electrical inlet and outlet being in communication with the electrical firing contacts;

an electrical inlet and an electrical outlet formed in the bolt shield, the electrical inlet and outlet being in communication with the electrical inlet and the electrical outlet formed at one end of the bolt; and a trigger subassembly coupled to the firearm receiver body, and operatively connected to the electrical firing contacts.

* * * * *